US006523312B2

(12) United States Patent
Budge

(10) Patent No.: US 6,523,312 B2
(45) Date of Patent: Feb. 25, 2003

(54) WALL FORMING SYSTEM FOR RETAINING AND NON-RETAINING CONCRETE WALLS

(76) Inventor: Paul W. Budge, P.O. Box 910758, St. George, UT (US) 84791

( * ) Notice: Subject to any disclaimer, the term of this patent is extended or adjusted under 35 U.S.C. 154(b) by 0 days.

(21) Appl. No.: 09/835,157

(22) Filed: Apr. 14, 2001

(65) Prior Publication Data

US 2002/0059761 A1 May 23, 2002

Related U.S. Application Data

(60) Provisional application No. 60/198,265, filed on Apr. 17, 2000.

(51) Int. Cl.[7] ..... E04B 2/18; E04B 2/26

(52) U.S. Cl. ..... 52/284; 52/259; 52/285.1; 52/564; 52/574; 52/590.2; 52/592.1; 52/592.5; 52/592.6; 404/42; 405/285; 405/286

(58) Field of Search ..... 52/604, 606, 607, 52/259, 284, 439, 590.2, 592.3, 574, 589.1, 591.1, 590.1, 285.1, 205.4, 564, 592.1, 592.5, 592.6; 404/41, 42–45; 405/30, 31, 33, 273, 275, 286; 446/405

(56) References Cited

U.S. PATENT DOCUMENTS

| | | | | |
|---|---|---|---|---|
| 511,304 A | | 12/1893 | Mapel | |
| 2,552,712 A | | 5/1951 | Ellis | |
| 3,410,044 A | | 11/1968 | Moog | |
| 3,717,967 A | | 2/1973 | Wood | |
| 3,855,751 A | | 12/1974 | Struthers | |
| 4,041,670 A | * | 8/1977 | Kaplan | 52/591 |
| 5,181,362 A | * | 1/1993 | Benitez | 52/594 |
| 5,404,685 A | | 4/1995 | Collins | |
| 5,685,119 A | | 11/1997 | Zschoppe | |
| 5,724,783 A | | 3/1998 | Mandish | |
| 5,839,249 A | | 11/1998 | Roberts | |
| 5,930,958 A | | 8/1999 | Stanley | |
| 6,088,987 A | * | 7/2000 | Simmons et al. | 52/592.6 |
| 6,141,933 A | * | 11/2000 | McClinton | 52/591.1 |

* cited by examiner

*Primary Examiner*—Yvonne M. Horton

(57) ABSTRACT

A novel wall forming system for retaining and non-retaining concrete walls (19) comprising of at least one flat wall foam panel (22), at least one radius wall foam panel (23), at least one corner wall foam panel (24) having the following features; a rod—male type connection (20) on one end and a groove—female type connection (21) on opposite end of all panels, allowing interlinking of panels in a straight line or swiveled one way or the other to form various angles or forming a radius line or forming a 90° degree angle. Panels having a header U-shaped horizontal cavity (26) for receiving a horizontal rebar (27) and horizontal concrete fill (33) to give strength at top of panels and having at least one "I" beam shaped vertical cavity (25) to receive a vertical rebar (28) and vertical concrete fill (34) to give vertical strength to panels and having a wet-set locking design bottom edge (31) being projected into a common concrete footing (35) for locking panels to footing, and having at least one vertical concrete post (29) located at least one "I" beam shaped vertical cavity (25), having alternate attachment of panels to footing by using a notched out masonry block (32). All exterior surfaces of panels may have stucco, stone, brick, plastic or concrete type finish (30).

7 Claims, 8 Drawing Sheets

WALL FORMING SYSTEM FOR RETAINING AND NON-RETAINING CONCRETE WALLS

This application claims the benefit of Provisional Application Ser. No. 60/198,265 filed Apr. 17, 2000.

BACKGROUND

1. Field of Invention

This invention relates in general to exterior retaining and non-retaining walls, in particular for a concrete forming system and apparatus for forming a concrete post and beam type structure on a concrete footing which allows various heights, and lengths of foam type panels to be interlinked end to end by a rod—male type and groove—female type connection system.

2. Description of Prior Art

Prior art are very elaborate in construction which have the capability of forming a retaining or non-retaining wall. The prior art have a higher cost in labor and material. The prior art walls are more complicated in assembling. The difficulties with the prior art walls is that the weight of the walls, which required a more intense footing, greatly increases the cost of the wall and, therefore, less affordable by the customer.

Another type insulated concrete form system has an insulated concrete form system for constructing the walls which has a multiplicity of insulated concrete form units. Each concrete form unit has a body, a tenon and a mortise located at each opposing end of the body. Each insulated concrete form unit is stacked vertically on each other forming a column. Therefore, the commercial use for this specific insulated concrete form system is limited because of its cost to manufacture and the greater number of pieces it takes to build a retaining or a non-retaining wall.

Another type foam block wall and fabrication method includes vertical passageways which are aligned by a block alignment element which has a first and a second edge for alignment surfaces for simultaneously engaging the internal passageways of the block causing angular spaced apart intervals to align the individual blocks. Therefore, this prior art is more elaborate in construction and higher labor cost. It also has a limited use since it can't make a circular shaped wall. My invention has a universal feature of a straight line, walls at 90 degrees to each other or an angular line in any direction from each other. Also, my invention can be laid in a circular line making my invention more versatile.

Another type Building Panel apparatus and method having a pluralilty of elongated panel frame members attached together to form a panel framework and having a stud attached between two panel frame members and having a panel side covering at least one side of the framework. This prior art is limited in its strength as a retaining wall. Therefore, the commercial use for this specific panel apparatus is limited. This prior art cannot be used as a circular line wall. My invention has a more general commercial application over this prior art Building Panel apparatus.

Another type-wall construction system includes a plurality of shaped bricks for dry attachment to one another. Each brick has a first bearing surface having a groove formed with a recess, and a second bearing surface being parallel in relationship to the first bearing surface and having a key which is formed with a projection. The projection and the recess have a compatible shape so the first brick is engageable with the recess of a second brick when the second brick is stacked on the first brick. The stacked bricks form a wall which is a straight line wall. Therefore, this prior art has a limited use because its lack of ability to make a circular line wall.

Another type polystyrene foamed plastic wall apparatus and method of construction. This prior art is limited in its commercial use because of its limited strength it can't be used as a retaining wall but only as a non-retaining wall.

Another type building block having elaborate design for use as a retaining wall. This prior art is a precast concrete structural member which is in the form of a generally elongated upright beam, having sufficient height to extend from the bottom to the top of a wall and formed in the shape of an elongated U-shape, with a deep narrow channel extending in a downwardly direction from the top of such member to a point near the bottom. The member will define inner and outer surfaces of the wall. The inner and outer parts being joined at the bottom by a solid area, which gives the structural member to be handled as a single structure and installed by hoisting equipment. This prior art is elaborate and its weight is so that extra equipment is needed to install it in place. Also, because of it's weight the footings need to be of greater size than my invention. Also, this prior art is for a straight-line construction wall not for a circular line construction such as my invention is capable of.

Another type block and building construction using same is a system that uses hollow modular masonry blocks, having a cavity between the side walls by which the side wall has an end flange adapted to laterally about a similar construction of an adjacent block. End flange serves to position and retain full-length vertically installed reinforcing bars through unobstructed vertically aligned cavities which are filled of concrete both horizontally and vertically in the entire wall. This prior art is elaborate in design and construction making it a very costly system. Therefore, this prior art is limited because of its cost for the customer.

Another type foamed plastic based construction elements is a wall construction made up of a plurality of molded construction elements, each having elements of a foamable plastic and comprises a low density core and a hard integrally formed smooth higher density skin and that each of the construction elements has an orifice molded therein and the skin completely encases the foamed core and forms a lining of the orifice, and concrete fills the orifice. This prior art can only be used for a straight line wall. It has no capability to be used for a circular line wall.

Another type keyed building block wall relates to building blocks having a key locking means engaging together for securing overlying courses of blocks. The locking keys are formed with short lengths of metal rods for interlocking engagement with subadjacent keys in a manner to substantially provide for vertical metal reinforcement which is used to secure in the masonry structure as the progress of the structure is advanced. This prior art can only be used for a straight line wall. It has no capability to be used for a circular line wall.

Another type construction block brick relates to the paving of streets, roads, walks, tracks and such places, which the public convenience, personal comfort, or a certain end to be gained required to be covered with a good and substantial pavement. This prior art is not designed for a retaining or non-retaining wail.

OBJECTS AND ADVANTAGES

Accordingly, besides the objects and advantages described above, several objects and advantages of the present invention are:

(a) to provide a concrete forming system and apparatus for forming a concrete post and beam type wall structure on a concrete footing.

(b) to provide a system of foam type panels in various heights and lengths to be interlinked end to end by a rod—male type and groove—female type connection system.

(c) to provide a structure for forming a concrete filled retaining or non-retaining wall.

(d) to allow wall panels to be set before or after concrete footing is poured due to its concrete wet-set locking design at bottom of each panel.

(e) to allow walls to be set and leveled in one step and then filled with concrete.

(f) to provide for foam panels with sufficient thickness, height and length and having sufficient "I"-beam shaped cavities to form an I-beam shaped concrete post that connects to a horizontal concrete header formed in the top of each panel and connected to a footing at the bottom of each panel.

(g) to allow rebar to be run horizontally and vertically as required.

(h) to allow foam panels to become a permanent part of this concrete and rebar wall.

(i) to provide foam panels to be easily coated with stucco or concrete type finish.

(j) to provide a rod—male type and groove—female type connection system which allows panels to be offset for elevation changes.

(k) to provide a novel feature which allows the panels to swivel one way or the other to form various angles to the right or to the left.

(l) to provide smaller semi-radius panels to be connected to form a desired radius.

(m) to allow panels to be shaped, grooved, or modified prior to concrete or stucco.

It is an object of the present invention to provide an improved wall forming system for retaining and non-retaining concrete walls.

Other objects and features are readily apparent from the following description of certain preferred embodiments thereof taken in conjunction with the accompanying drawings although variations and modifications may be affected without departing from the sphere and the scope of the normal concepts of the disclosed invention. You will find further objects and advantages of the invention from a consideration of the ensuing descriptions and accompanying drawings.

DRAWING FIGURES

DRAWING REFERENCE NUMERALS

Figure 1:
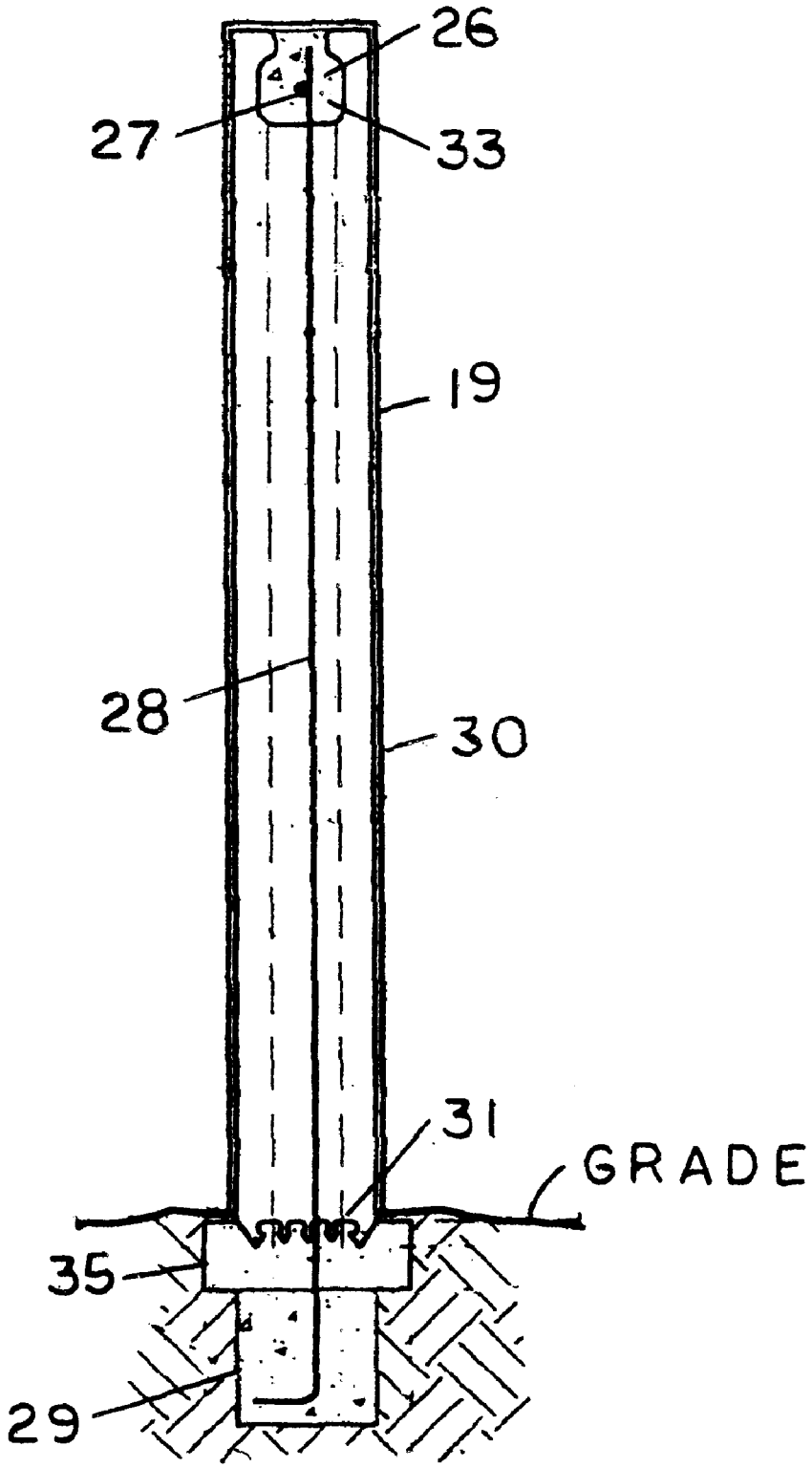
FIG. 1 Shows a cross-sectional view of the wall forming system, taken along the line 1—1 FIG. 2.

19 wall forming system for retaining and non-retaining concrete wall
20 rod—male type connection
21 groove—female type connection
22 flat wall foam panel
23 radius wall foam panel
24 corner wall foam panel
25 "T" beam shaped vertical cavity for concrete fill
26 header U-shaped horizontal cavity for concrete fill
27 horizontal rebar
28 vertical rebar
29 vertical concrete post
30 stucco, stone, brick, plastic or concrete type finish
31 wet-set locking design bottom edge
32 notched out masonry block
33 horizontal concrete fill
34 vertical concrete fill
35 common concrete footing

DESCRIPTION OF INVENTION

Figure 2:
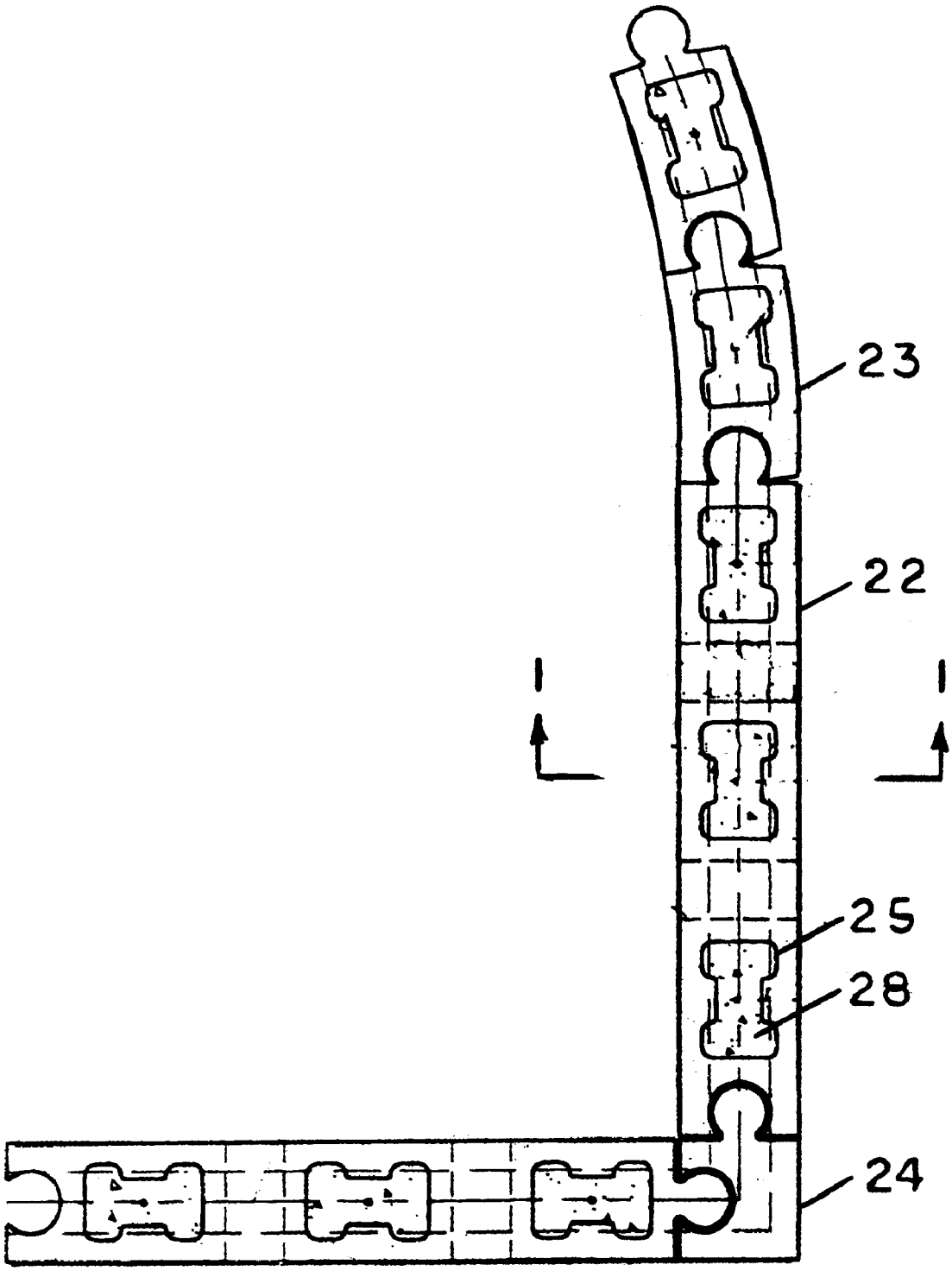
FIG. 2 Shows a top view of a wall forming system with flat panels, radius panels and corner panel.
Figure 5:
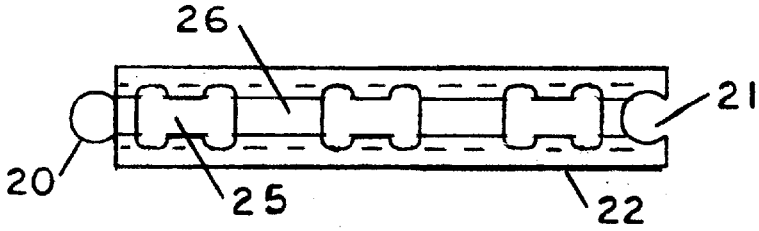
FIG. 5 Shows a top view of a flat panel.
Figure 3:
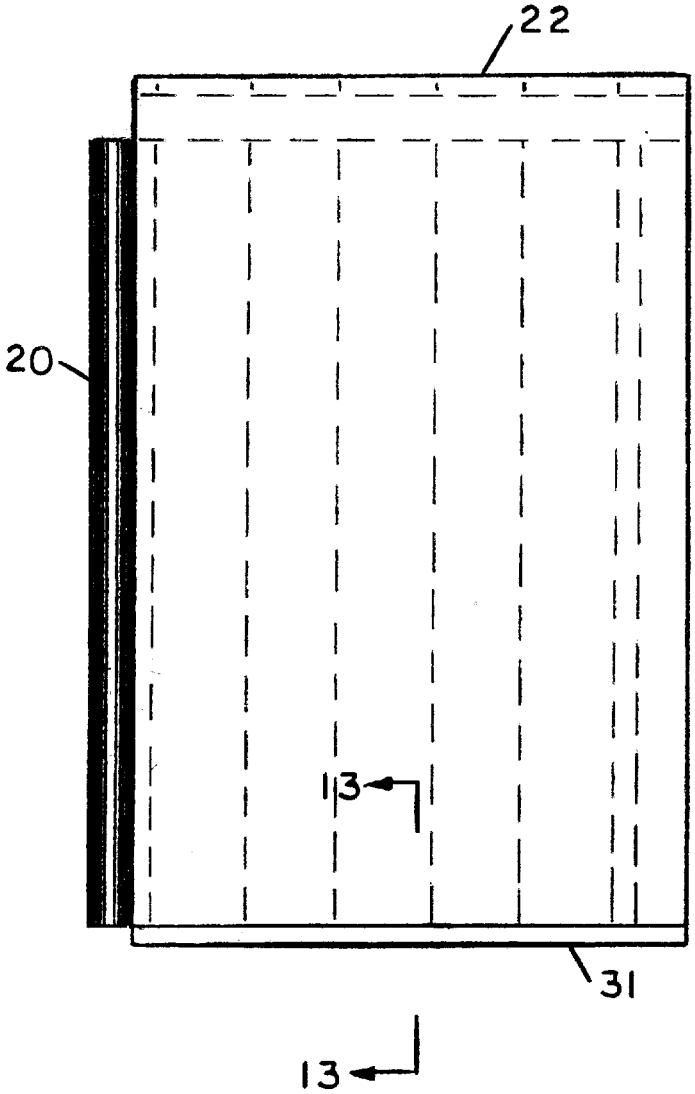
FIG. 3 Shows a front view of a flat panel with a rod end and a groove end.
Figure 4:
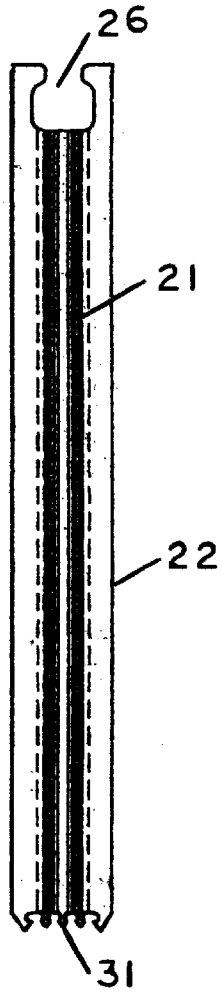
FIG. 4 Shows an end view of a flat panel with a groove end with a header U-shaped horizontal cavity at top of panel and with locking wet-set at bottom of panel.
Figure 8:
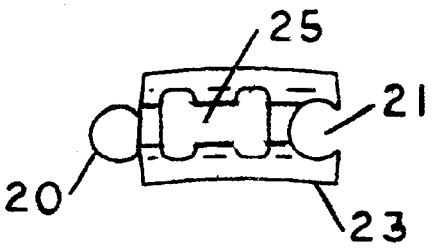
FIG. 8 Shows a top view of a radius panel.
Figure 6:
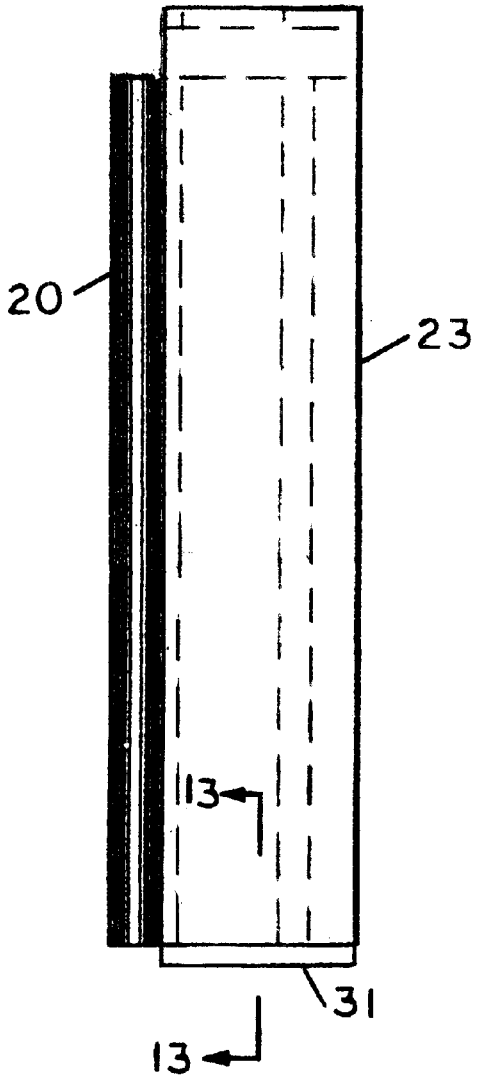
FIG. 6 Shows a front view of a radius panel with a rod end and a groove end.
Figure 7:
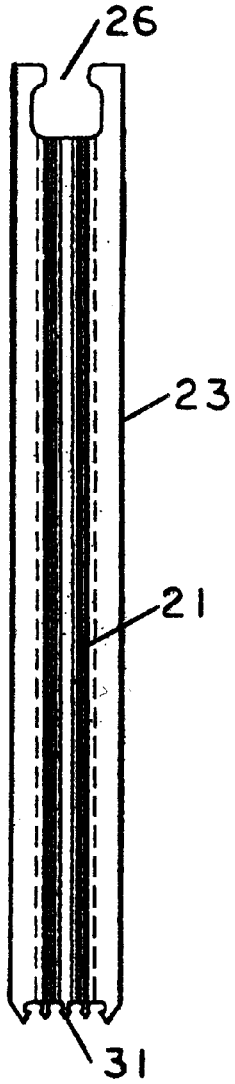
FIG. 7 Shows an end view of a radius panel with a groove end with a header U-shaped horizontal cavity at top of panel and with locking wet-set at bottom of panel.
Figure 11:
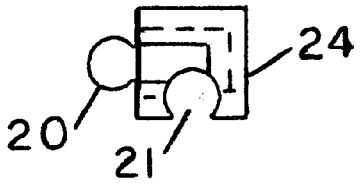
FIG. 11 Shows a top view of a corner panel.
Figure 9:
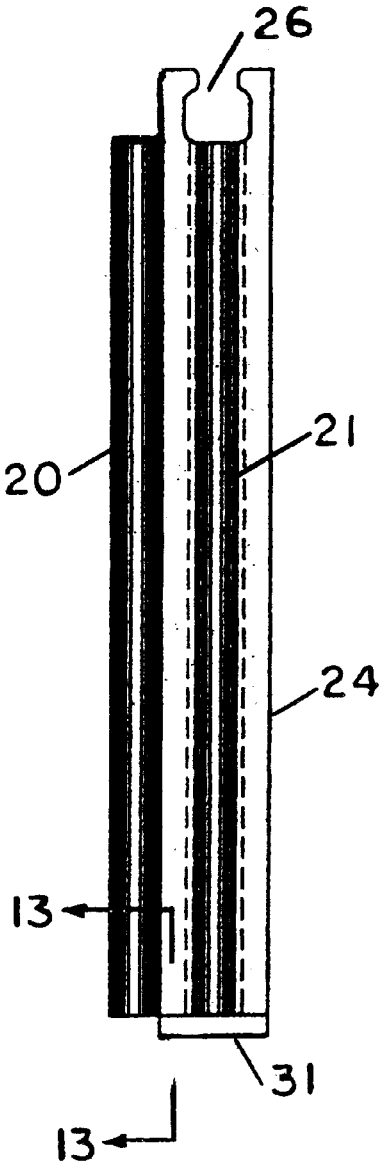
FIG. 9 Shows an end view of a corner panel with a groove end facing forward and with the rod end facing to the left with a header U-shaped horizontal cavity at top of panel.
Figure 10:
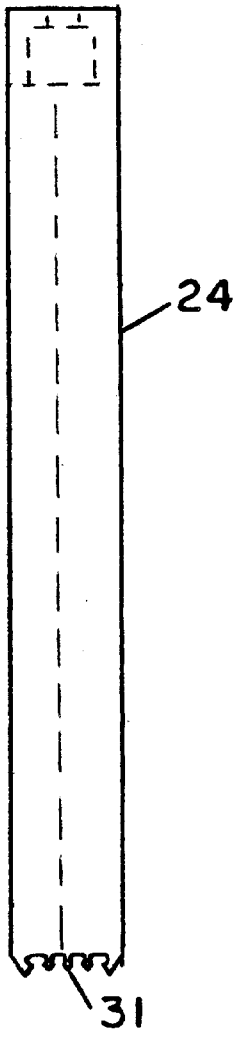
FIG. 10 Shows a front view of a corner panel with locking wet-set at bottom of panel.
Figure 12:
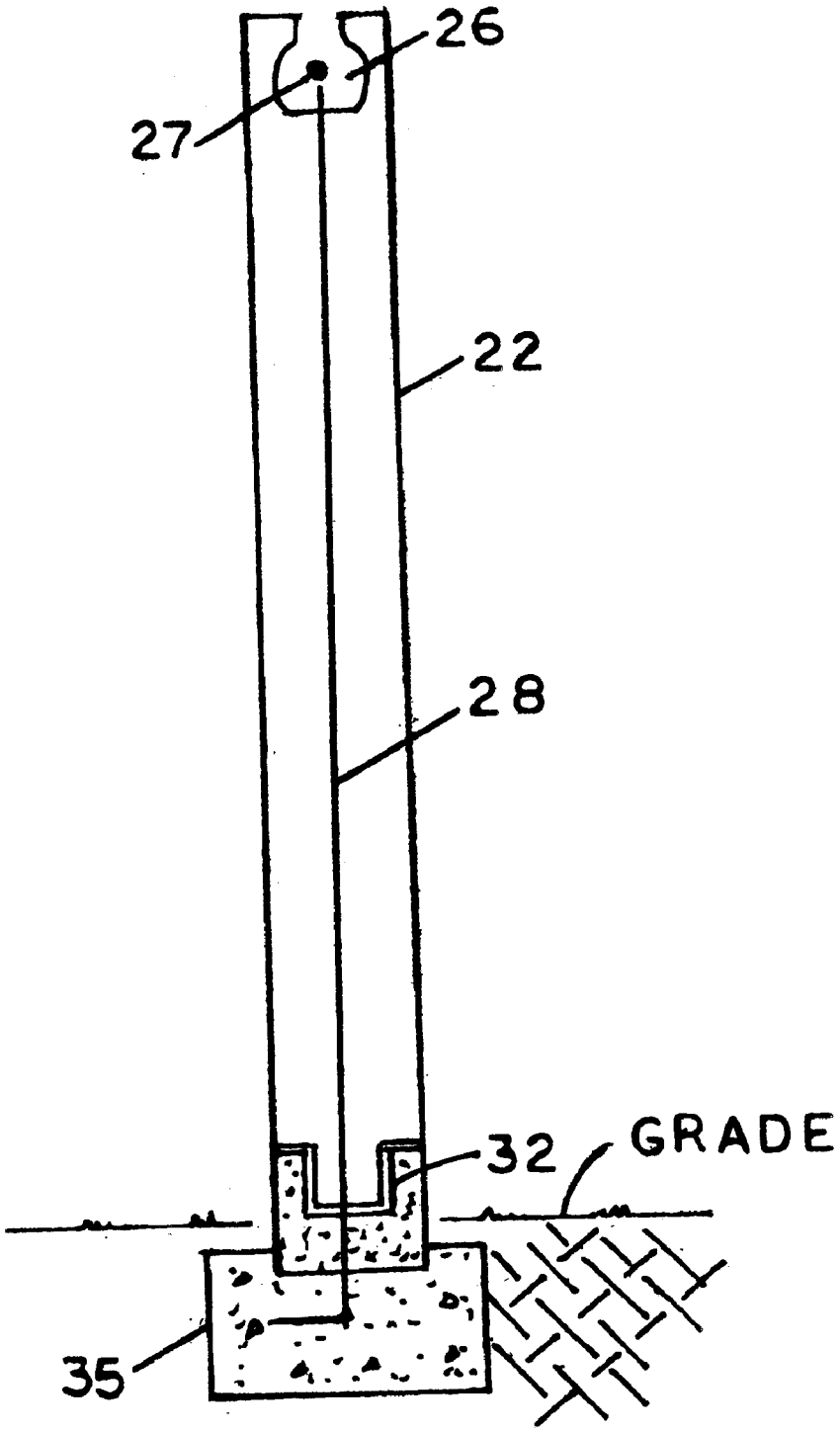
FIG. 12 Shows a cross-sectional view of the wall forming system with notched-out masonry block at bottom of panel.
Figure 13:
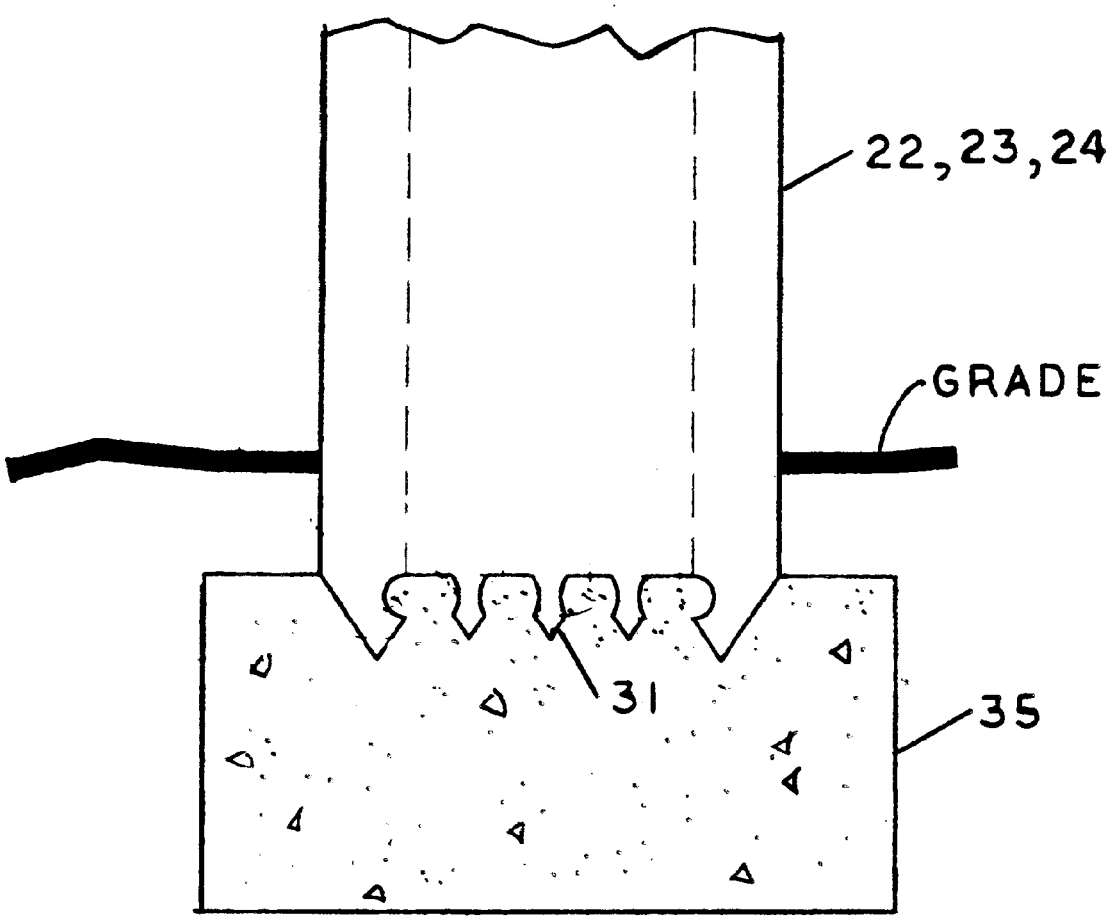
FIG. 13 Shows a cross-sectional view of the locking wet-set at bottom of panel, taken along the line 13—13 FIG. 3, FIG. 6 and FIG. 9.
Figure 14:
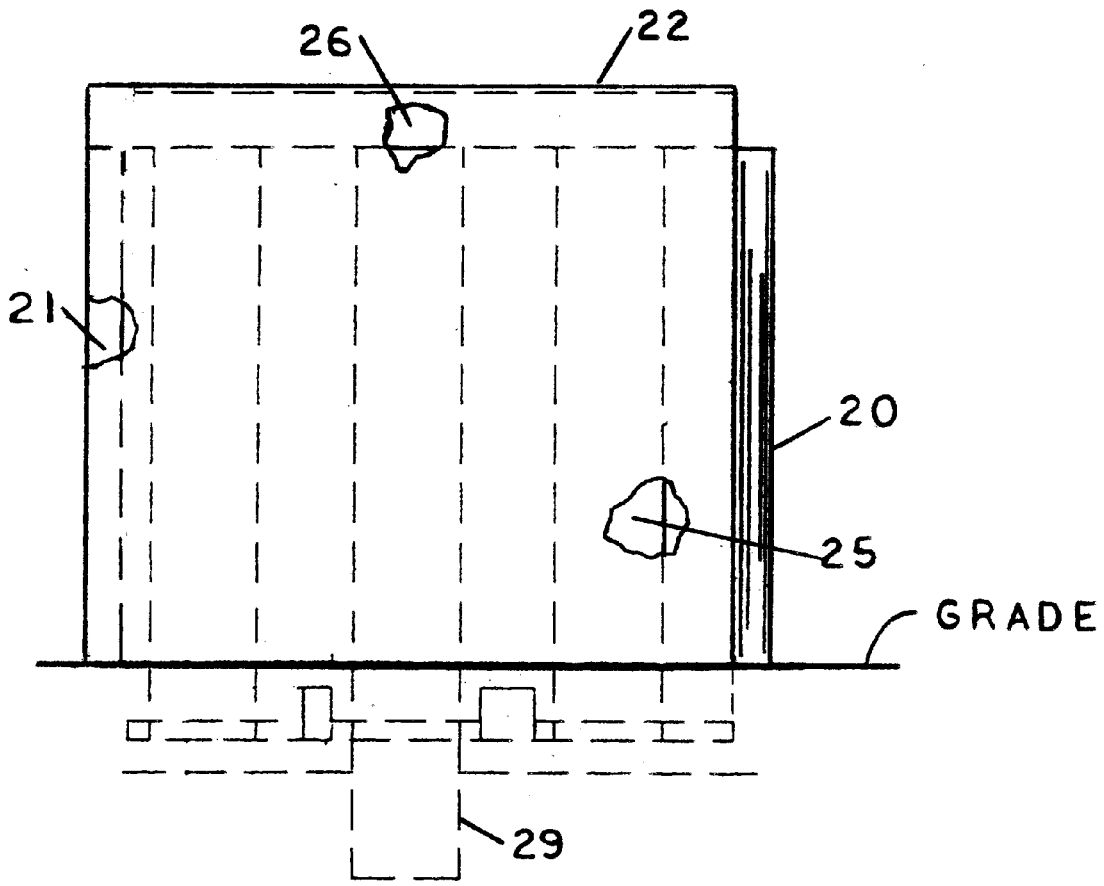
FIG. 14 Shows a front view of a panel with location of concrete cells and location of concrete post footing.

The wall forming system for retaining and non-retaining concrete walls 19 shown in FIG. 1, FIG. 2, FIG. 3, FIG. 4, FIG. 5, FIG. 6, FIG. 7, FIG. 8, FIG. 9, FIG. 10, FIG. 11, FIG. 12, FIG 13 and FIG. 14, comprised of at least one flat wall foam panel 22 having sufficient thickness, width and length, at least one radius wall foam panel 23 having sufficient thickness, width and length, at least one corner wall foam panel 24 having sufficient thickness, width and length, said flat wall foam panel 22, radius wall foam panel 23 and corner wall foam panel 24 having the following features: a rod—male type connection 20 having sufficient thickness, width and length on one end of panel and a groove—female type connection 21 having sufficient thickness, width and length on opposite end of panel, the rod—male type connection 20 slides inside the groove—female type connection 21 causing a hinge type connection allowing interlinking panels to be lined up in a straight line or to be swiveled one way or the other to form various angles or by using the radius wall foam panel 23, as the interlinking panel a desired curved line can be made or by using the corner wall foam panel 24, as the interlinking panel a 90 degree angle can be made when desired, FIG. 2. The flat wall foam panel 22 and radius wall foam panel 23 and corner wall foam panel 24 having a header U-shaped horizontal cavity 26 having sufficient width, depth and length to receive a horizontal rebar 27 having sufficient strength and sufficient concrete fill 33 to give strength at top of panels. Flat wall foam panel 22 and radius wall foam panel 23 having an "I"-beam shaped vertical cavity 25 having sufficient thickness, width and length to receive a vertical rebar 28 having sufficient strength and with sufficient concrete fill 34. Flat wall foam panel 22, radius wall foam panel 23 and corner wall foam panel 24 having a wet-set locking design bottom edge 31 FIG. 1, FIG. 4, FIG. 7, FIG. 10 and FIG. 13 being projected into the common concrete footing 35 allowing the wet concrete to harden around the wet-set locking design bottom edge 31 thereby locking the panels to the common concrete footing 35. Flat wall foam panel 22 and radius wall foam panel 23 having a vertical concrete post 29 FIG. 14 at desired locations by using the "I"-beam shaped vertical cavity for concrete fill 25 which has sufficient depth in the soil below the common concrete footing 35 thereby giving the panels extra vertical strength to the retaining or non-retaining wall the flat wall foam panel 22, radius wall foam panel 23 and corner wall foam panel 24 may be attached to the common concrete footing 35 by using a notched out masonry block 32 FIG. 12, by notching said panels at bottom edge to form to the configuration of the notched out masonry block 32. The flat wall foam panel 22, radius wail foam panel 23 and corner wall foam panel 24, all exterior surfaces of said panels to have a stucco, stone, brick, plastic or concrete type finish 30, or a combination of these finishes. The wall forming system for retaining and non-retaining concrete walls 19 may be made with different decorative designs such as squared cap, ornate beveled wall, cap and post, rounded edges, beveled edges, wrought iron insert, wrought iron standard cap and post or any combination of these decorative designs. The wall forming system for retaining and non-retaining concrete walls 19 can be made from concrete, stone, brick, foam, plastic, wood, iron, steel, aluminum, or any other type metal, polyurethane type composite with fiber glass, high density expanded polystyrene, plastic or any combination of these materials.

Conclusion and Scope of Invention

Accordingly, the reader will see that the wall forming system for retaining and non-retaining concrete walls of this invention has the ability to be installed in a fraction of the time compared to masonry or solid concrete walls with about the same or less in total material costs. Furthermore, the wall forming system has the additional advantages in that:

- it provides the ability to develop a crack free retaining and non-retaining decorative privacy wall.
- it provides a decorative wall that will have no alkali staining.
- it provides a wall with no block lines or block line cracking.
- it provides a wall with no staining problems.
- it provides a 3 to 4 times higher strength to weight ratios than masonry or solid concrete walls.
- it provides for the walls to be set and leveled in one step and then filled with concrete.
- it provides for the panels to be shaped, grooved or modified prior to applying the concrete or stucco.
- it allows the panels to be offset for elevation changes.
- it allows the panels to be swiveled one way or the other to form various angles to form a desired radius.
- it provides a unique rod and groove interlinkig system that allows unlimited design possibilities for creating virtually any radius, angle, or elevation change simply by sliding panels up and down on the rod end or by swiveling them on the rod.
- it provides the ability for wall panels to be shaped on top to follow the terrain or hot grooved with unlimited designs.
- it allows pilasters and caps to be easily installed in any size or design on any centerline location desired after walls are poured. Although the description above contains many specifications, these should not be construed as limiting the scope of the invention but merely providing illustrations of some of the presently preferred embodiments of this invention. For example, the flat, radius, and corner panels rod—male type connection and groove—female type connection can have other shapes, such as square, oval, trapezoidal, triangular, etc. The exterior surface of the panels can be of different material combinations.

Thus, the scope of the invention should be determined by the appended claims and their legal equivalents, rather than by the examples given.

I claim as my invention:

1. A wall forming system for retaining and non-retaining concrete walls comprising at least one flat wall foam panel, at least one radius wall foam panel, and at least one corner wall foam panel each having a thickness, width and length; wherein at opposite ends thereof a male and a female connector allowing adjacent panels to interlink in a straight or swivel configuration to form a wall of varying angles, a header U-shaped horizontal cavity disposed in substantially an upper portion of the panels, a horizontal rebar and concrete fill disposed in the header U-shaped cavity to strengthen the top of the panels.

2. The wall forming system according to claim 1, wherein the male connector includes a rod and female connectors includes groove.

3. The wall forming system according to claim 1, further including a plurality of I-shaped cavities receiving a vertical rebar and vertical concrete fill to provide the system with vertical strength.

4. The wall forming system according to claim 2, further including a plurality of I-shaped cavities receiving a vertical rebar and vertical concrete fill to provide the system with vertical strength.

5. The wall forming system according to claim 1, further including a wet-set locking design bottom edge projected into a common concrete footing allowing wet concrete to harden around the wet-set locking design bottom edge causing the panels to lock to the common concrete footing.

6. The wall forming system according to claim 1, further including at least one notched out masonry block and common footing having an edge configured to complement the at least one notched out masonry block thereby causing the panels to lock with the common concrete footing.

7. The wall forming system according to claim 1, further including an exterior finish in at least one of the group consisting of stucco, stone, brick, plastic and any combination thereof.

* * * * *